US011445320B1

(12) United States Patent
Heinrich Kares

(10) Patent No.: US 11,445,320 B1
(45) Date of Patent: Sep. 13, 2022

(54) DEVICE FOR PROCESSING MULTI-CHANNEL AUDIO SIGNALS, METHOD FOR PROCESSING MULTI-CHANNEL AUDIO SIGNALS, AND COMPUTER-READABLE STORAGE MEDIUM

(71) Applicant: Sennheiser electronic GmbH & Co. KG, Wedemark (DE)

(72) Inventor: Johannes Heinrich Kares, Zürich (CH)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 17/360,251

(22) Filed: Jun. 28, 2021

(51) Int. Cl.
*H04S 7/00* (2006.01)
*H04R 5/04* (2006.01)

(52) U.S. Cl.
CPC ..... *H04S 7/302* (2013.01); *H04R 5/04* (2013.01); *H04R 2499/13* (2013.01); *H04S 2400/01* (2013.01); *H04S 2400/05* (2013.01)

(58) Field of Classification Search
CPC ..... H04S 2400/05
See application file for complete search history.

(56) References Cited

U.S. PATENT DOCUMENTS

2017/0272884 A1* 9/2017 Aoki ..... H04S 5/005

* cited by examiner

*Primary Examiner* — Ping Lee
(74) *Attorney, Agent, or Firm* — Haug Partners LLP

(57) ABSTRACT

Embodiments of the invention provide for a device and method for processing multi-channel audio signals, the multi-channel audio signals comprising at least a left channel, a right channel, and a center channel. Embodiments of the invention also provide for a non-transitory computer-readable storage medium having stored thereon instructions that when executed on a computer cause the computer to perform the method.

11 Claims, 2 Drawing Sheets

DEVICE FOR PROCESSING MULTI-CHANNEL AUDIO SIGNALS, METHOD FOR PROCESSING MULTI-CHANNEL AUDIO SIGNALS, AND COMPUTER-READABLE STORAGE MEDIUM

FIELD OF DISCLOSURE

The present invention relates to a device for processing multi-channel audio signals. The invention also relates to a method for processing multi-channel audio signals and to a computer-readable storage medium.

BACKGROUND

Audio signals are usually optimized for reproduction in a standardized environment. Especially multi-channel audio signals require loudspeakers at defined positions relative to a single listener in order to result in an intended particular spatial image. The listener's ideal position is known as the sweet spot. However, in some cases, the audio reproduction is aimed at two listeners, such as in a car. The listeners, in this case, have defined positions, but are usually not in the sweet spot. Thus, it may be desirable to optimize audio signals for reproduction in such an environment.

Creating a proper spatial image in cars is difficult. In a standardized environment such as a recording studio, the listener can be placed in the sweet spot where the distances and the angles between the listener and the speakers are as prescribed, e.g., symmetrical. In cars with usually two or more seats in the front, however, this is not possible. While most cars have left and right speakers, a simple and effective approach is to add a center speaker, so that imaging becomes more symmetrical. In the simplest form, as shown in FIG. 1, the center speaker $LS_C$ is fed a signal that is obtained by summing up S1 the left and the right channel L, R. This approach has a severe drawback: The width of the stereo image is drastically reduced because the center speaker $LS_C$ plays the same signals as the outer speakers $LS_L$, $LS_R$. To improve this, a known solution that is shown in FIG. 2 is to use a center extraction algorithm CEX to extract correlated information from the input audio signals L, R. The extracted information CS is then played back on both the center speaker $LS_C$ and the outer speakers $LS_L$, $LS_R$ to create two virtual centers with a symmetrical image. With this arrangement, information in the center of the image still appears in front of each of the passengers P1, P2. This has the advantage that correlated information, such as e. g. the main vocals in a song, is perceived in front of the passengers. In contrast, decorrelated information uses the entire width of the available stage.

A new set of challenges arises with the introduction of immersive audio formats into the car. The most commonly used immersive audio formats, such as 5.1 Surround sound, 7.1 Surround sound, Dolby Surround, Dolby Atmos. Auro 3D, and MPEG-H, have three front channels: Front Left, Front Center, and Front Right. The immersive audio formats usually have additional channels, but these are not considered here. A simple approach is just to play the left and right channels on left and right speakers and use the center channel to create two virtual centers or phantom centers. This can be achieved by an arrangement as shown in FIG. 3 with two summation blocks S21, S22 that add the center channel to the left and right channels, respectively. As a result, each virtual center is in front of one of the passengers, so that the signal in the center channel is perceived directly in front by each of the passengers.

However, while this approach works for some scenarios, it does not work for others. In particular, music may be mixed in different ways. Usually, information that should be perceived in front of the listener, e. g. the main vocals, is mixed into the center channel. In another commonly used mixing style however, such information is mixed into the left and right channel. In a studio environment, this works well since it creates a phantom center for the listener's perception. Moreover, it can have the effect of the instruments blending in better with the voice, which is why many sound engineers choose this approach during the mixing process. However, in an environment where the listener is not located in the sweet spot, such as in a car, the image of the voice will not be centered directly in front in this case, but moved outwards to either the left (for the driver/passenger on the left) or the right (for the passenger/driver on the right). Moreover, the music is usually not tagged to indicate which mixing style was applied. It is therefore difficult to enable a correct reproduction of either style.

SUMMARY OF THE INVENTION

An object of the present invention is therefore to provide a solution for the problems mentioned above.

As described in the following, the invention solves the problem and is suitable for creating two phantom centers, one in front of each listening position. Advantageously, the solution works regardless of the mixing style. The input multi-channel audio signals can have a conventional format like, for example, one of 5.1 Surround sound, 7.1 Surround sound, Dolby Surround, Dolby Atmos, Auro 3D, and MPEG-H.

In an embodiment, a method for processing multi-channel audio signals that include at least a left channel, a right channel, and a center channel comprises performing a center extraction for the left channel and right channel, wherein a left remainder signal and a right remainder signal remain, adding the extracted center signal to the center channel to obtain an enhanced center channel and add the enhanced center channel to both the left remainder and the right remainder signal. For reproduction, the left and right remainder signals with the enhanced center channel respectively added are provided then to left and right speakers, and the enhanced center channel is provided to a center speaker.

In a further embodiment, the invention relates to a device for processing multi-channel audio signals that include at least a left channel, a right channel, and a center channel. The device comprises a center extraction unit adapted for extracting a center signal from the left channel and right channel, wherein a left remainder signal and a right remainder signal remain. The device further comprises a first summation unit for adding the extracted center signal to the center channel to obtain an enhanced center channel and two more summation units for adding the enhanced center channel to the left and the right remainder signal, respectively. The device provides, on respective outputs, the enhanced center channel and the respective summation results of the left and the right remainder signals with the enhanced center channel.

In yet a further embodiment, the invention relates to a computer-readable storage device having stored thereon instructions that when executed on a computer cause the computer to perform the method as described above.

Further advantageous embodiments are disclosed in the detailed description below.

BRIEF DESCRIPTION OF THE DRAWINGS

Details and further advantageous embodiments of the present invention may be better understood by reference to the accompanying figures, which show in FIG. 1 shows a first conventional audio signal processing.

DETAILED DESCRIPTION OF EXAMPLE/PREFERRED EMBODIMENTS

Figure 1:
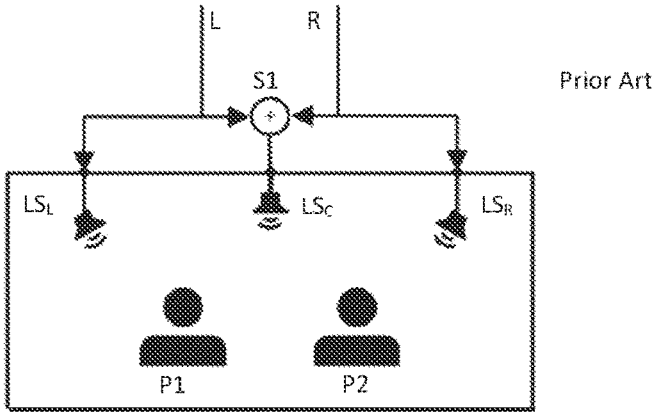
Figure 2:
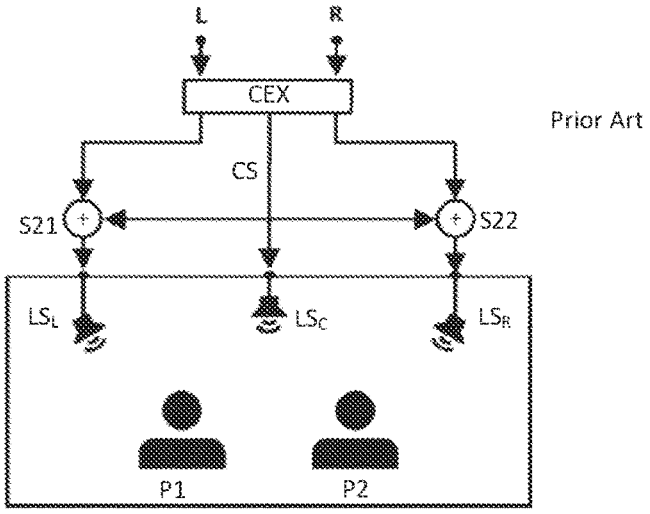
FIG. 2 shows a second conventional audio signal processing.
Figure 3:
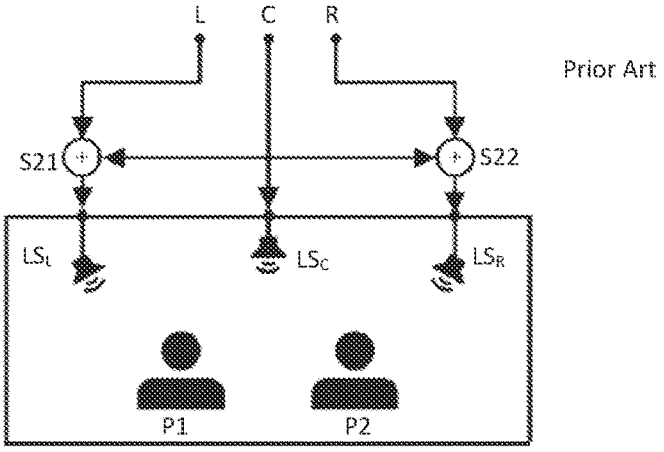
FIG. 3 shows a third conventional audio signal processing.
Figure 4:
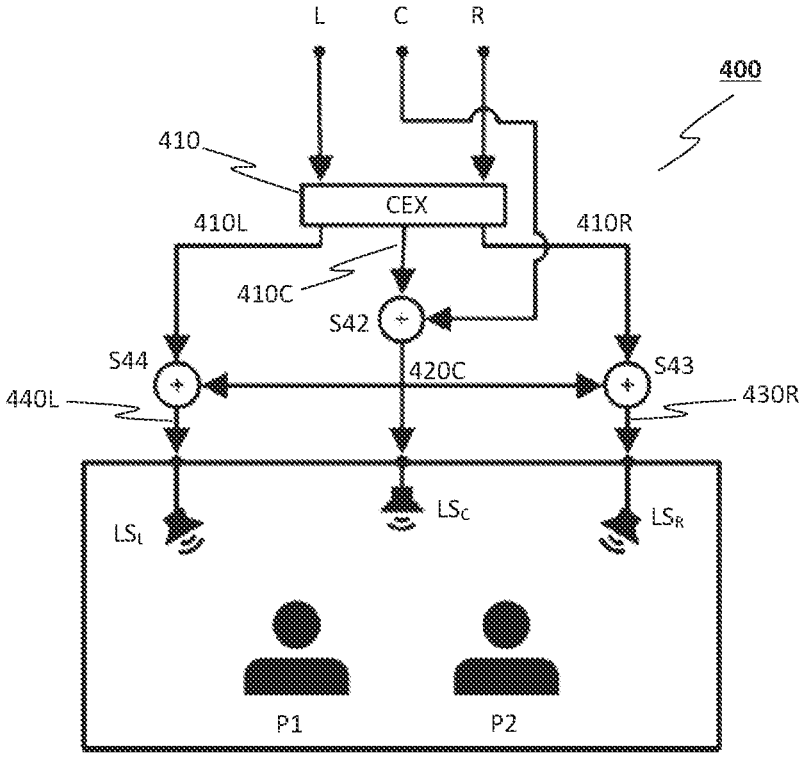
FIG. 4 shows a block diagram of an audio processing unit.

FIG. 4 shows a block diagram of an audio processing unit 400, according to an embodiment of the invention. The audio processing unit 400 is a device for processing multi-channel audio input signals that include at least a left channel L, a right channel R, and a center channel C. The device comprises a center extraction unit 410 that is adapted for extracting a center signal 410C from a combination of the left channel L and the right channel R of the multi-channel signal. The center extraction unit 410 may perform a correlation between the left channel L and the right channel R, and provide correlated portions thereof 410C to subsequent processing stages. The center extraction unit 410 also provides the respective remainders 410L, 410R to subsequent processing stages. The device further comprises at least three summation units S42-S44. A first summation unit S42 is adapted for adding the extracted center signal 410C to the center channel C of the multi-channel audio input signal to obtain an enhanced center channel 420C. A second summation unit S43 is adapted for adding the enhanced center channel 420C to the center extraction's remainder 410R of the right channel R to obtain an enhanced right channel 430R. A third summation unit S44 is adapted for adding the enhanced center channel 420C to the center extraction's remainder 410L of the left channel L to obtain an enhanced left channel 440L.

Each of the center extraction unit 410 and the summation units S42, S43, S44 may be implemented by one or more hardware elements, such as one or more processors and/or adders, that may but do not need to be configurable by software.

The enhanced left channel 440L, enhanced right channel 430R, and enhanced center channel 420C are provided to respective outputs of the device. They may be fed to respective loudspeakers $LS_L$, $LS_C$, $LS_R$ positioned near two listening positions P1, P2 as follows: A first speaker $LS_L$ is positioned to the left and in front of the listening positions P1, P2. A second speaker $LS_R$ is positioned to the right and in front of the two listening positions P1, P2. Finally, a third speaker $LS_C$ is positioned in the middle and in front of the two listening positions P1, P2. Thus, the listening positions P1, P2 may be two adjacent seats in a car, particularly the driver seat and the passenger seat. However, the listening positions can also be located in other, similar environments. Advantageously, the arrangement provides two phantom centers, one in front of each listening position, for all audio information that should be perceived in front of each listener.

The multi-channel audio signal may comprise analog or digital audio signals. Further, it may also comprise one or more additional audio channels, which may be provided to one or more further speakers e. g. to the side of or behind the listening positions P1, P2. These are not considered here. All processing mentioned above, except for the center extraction, may be performed in the analog domain. In particular, the summation units may perform analog summation or simple superposition of signals. In the case of analog audio input signals, additional analog-to-digital converters (ADC, not shown) for digitizing at least the left and right audio channels L, R are included. If the summation units S42-S44 perform analog summation, also additional digital-to-analog converters (DAC, not shown) are provided for converting the output signals of the center extraction unit 410 into analog signals. The ADCs and/or the DACs may also be part of the center extraction unit 410. Alternatively, the processing may also be performed entirely in the digital domain. In this case, either the input audio signal may be a digital signal, or the device may have a digitization stage (ADC) for digitizing all analog input signals. In the case of digital processing, the device may optionally also comprise a DAC for obtaining analog output signals.

In one embodiment, the invention relates to a system comprising a device for processing multi-channel audio signals as described above and at least three speakers positioned relative to two listening positions as described above.

Figure 5:
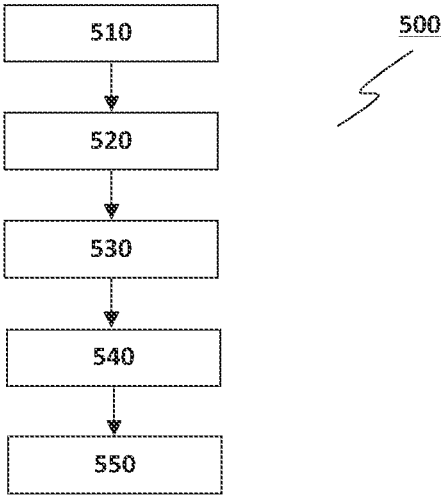
FIG. 5 shows a flow-chart for audio processing.

In one embodiment, the invention relates to a method for audio processing, and in particular for processing multi-channel audio signals that comprise at least a left channel L, a right channel R, and a center channel C. FIG. 5 shows a flow-chart 500 of the method, according to an embodiment. The method 500 comprises performing 510 a center extraction for the left channel L and the right channel R to obtain an extracted center signal 410C, wherein a left remainder signal 410L and a right remainder signal 410R remain. The method further comprises adding 520 the extracted center signal 410C to the center channel C of the multi-channel audio signal to obtain an enhanced center channel 420C, adding 530 the enhanced center channel 420C to the left remainder signal 410L to obtain an enhanced left channel 440L, and adding 540 the enhanced center channel 420C to the right remainder signal 410R to obtain an enhanced right channel 430R. The enhanced left channel 440L, the enhanced right channel 430R, and the enhanced center channel 420C can be converted to analog signals if required and then provided 550 for output to respective speakers.

In particular, the enhanced left channel 440L can be provided to a first speaker $LS_L$ positioned to the left and in front of two listening positions P1, P2. Likewise, the enhanced right channel 430R can be provided to a second speaker $LS_R$ positioned to the right and in front of the two listening positions P1, P2. Finally, the enhanced center channel 420C can be provided to a third speaker $LS_C$ positioned substantially in the middle and in front of said two listening positions P1, P2. Optionally, the enhanced channel signals 440L, 430R, 420C can be fed to additional processing units, such as, e.g., speaker management and delay adjustment, before being fed to the corresponding physical speaker.

The invention is particularly advantageous for correctly processing multi-channel audio signals, independent of how they are mixed, and in cases where neither of two listeners can be located in the conventional sweet spot. That is, the sound that is meant to be perceived in front of the listener will be perceived in the intended way for each of the two listeners, whether the center information is mixed into the center channel or distributed to the left and right channels. Even intermediate solutions where the center information is partly mixed into the center channel and partly distributed can be reproduced as intended. In each case, two phantom centers are created, one for each listener. This means that improved sound reproduction e. g. in cars is possible. However, the invention can also be used in other environments like home cinema, trains, public spaces, etc. It may also be adapted for audio formats with more than three speakers in the front.

While various embodiments have been described, it is clear that combinations of features of different embodiments may be possible, even if not expressly mentioned herein. Accordingly, such combinations are considered to be within the scope of the present invention.

The invention claimed is:

1. A device for processing multi-channel audio signals that include at least a left channel, a right channel, and a center channel, the device comprising:

a center extraction unit adapted for extracting a center signal from the left channel and the right channel, wherein a left remainder signal and a right remainder signal remain;

a first summation unit for adding the extracted center signal to the center channel of the multi-channel audio signal to obtain an enhanced center channel;

a second summation unit adapted for adding the enhanced center channel to the right remainder signal to obtain an enhanced right channel;

a third summation unit adapted for adding the enhanced center channel to the left remainder signal to obtain an enhanced left channel; and outputs for providing the enhanced left channel, the enhanced right channel, and enhanced center channel.

2. The device of claim 1, wherein the center extraction unit is adapted for performing a correlation between the left channel and the right channel of the multi-channel audio signal and for providing correlated portions thereof.

3. The device of claim 1, wherein the center extraction unit is a digital processing unit, and the first, second and third summation units perform digital summation.

4. The device of claim 1, wherein the center extraction unit is a digital processing unit, further comprising a digital-to-analog converter for converting the signals provided by the center extraction unit into analog signals, and wherein the first, second, and third summation units perform analog summation.

5. The device of claim 1, wherein the multi-channel audio signal comprises one or more additional audio channels, the one or more additional audio channels being provided to one or more further speakers to the side of or behind listening positions.

6. A system comprising:

a device for processing multi-channel audio signals as set forth in claim 1;

at least three speakers, with a first speaker positioned to the left and in front of two listening positions, a second speaker positioned to the right and in front of the two listening positions, and a third speaker positioned substantially in the middle and in front of said two listening positions;

wherein the first speaker receives the enhanced left channel, the second speaker receives the enhanced right channel, and the first speaker receives the enhanced center channel.

7. A method for processing multi-channel audio signals, the multi-channel audio signals comprising at least a left channel, a right channel, and a center channel, the method comprising:

performing a center extraction for the left channel and right channel to obtain an extracted center signal, wherein a left remainder signal and a right remainder signal remain;

adding the extracted center signal to the center channel of the multi-channel audio signal to obtain an enhanced center channel;

adding the enhanced center channel to the left remainder signal to obtain an enhanced left channel;

adding the enhanced center channel to the right remainder signal to obtain an enhanced right channel; and providing the enhanced left channel, the enhanced right channel, and the enhanced center channel for output to respective speakers.

8. The method of claim 7, wherein the enhanced left channel is provided to a first speaker positioned to the left and in front of two listening positions, the enhanced right channel is provided to a second speaker positioned to the right and in front of the two listening positions, and the enhanced center channel is provided to a third speaker positioned substantially in the middle and in front of said two listening positions.

9. The method of claim 8, wherein the two listening positions are two adjacent seats in a car.

10. The method of claim 9, wherein the two adjacent seats are the driver seat and the passenger seat.

11. A non-transitory computer-readable storage medium having stored thereon instructions that when executed on a computer cause the computer to perform a method according to claim 7.

* * * * *